US007084842B2

(12) United States Patent
Kim et al.

(10) Patent No.: US 7,084,842 B2
(45) Date of Patent: Aug. 1, 2006

(54) APPARATUS AND METHOD FOR DRIVING LIQUID CRYSTAL DISPLAY DEVICE

(75) Inventors: Cheol Se Kim, Daegu-kwangyokshi (KR); Kwang Soon Park, Daegu-kwangyokshi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 164 days.

(21) Appl. No.: 10/386,506

(22) Filed: Mar. 13, 2003

(65) Prior Publication Data

US 2004/0119671 A1 Jun. 24, 2004

(30) Foreign Application Priority Data

Dec. 20, 2002 (KR) ..... 10-2002-0081979

(51) Int. Cl.
*G09G 3/36* (2006.01)

(52) U.S. Cl. ..... 345/87; 345/90; 345/92; 345/698

(58) Field of Classification Search ..... 345/87, 345/38, 92, 43, 90, 698, 205, 695–6
See application file for complete search history.

(56) References Cited

U.S. PATENT DOCUMENTS

| | | | | |
|---|---|---|---|---|
| 6,011,531 | A * | 1/2000 | Mei et al. | 345/92 |
| 6,097,453 | A * | 8/2000 | Okita | 349/43 |
| 6,633,306 | B1 * | 10/2003 | Marz et al. | 345/698 |
| 2002/0047822 | A1 * | 4/2002 | Senda et al. | 345/90 |

* cited by examiner

*Primary Examiner*—Sumati Lefkowitz
*Assistant Examiner*—Tammy Pham
(74) *Attorney, Agent, or Firm*—McKenna Long & Aldridge LLP

(57) ABSTRACT

An apparatus and method for driving a liquid crystal display device are disclosed in the present invention. The liquid crystal display device includes a plurality of data lines in a vertical direction, a plurality of gate lines in a horizontal direction to cross the data lines, and a plurality of liquid crystal cells along with each gate line, wherein one of the data lines applies a video signal to at least three liquid crystal cells.

47 Claims, 8 Drawing Sheets

APPARATUS AND METHOD FOR DRIVING LIQUID CRYSTAL DISPLAY DEVICE

This application claims the benefit of the Korean Patent Application No. P2002-081979 filed on Dec. 20, 2002, which is hereby incorporated by reference.

BACKGROUND OF THE INVENTION

1. Field of the Invention

The present invention relates to a liquid crystal display, and more particularly, to an apparatus and method for driving a liquid crystal display device. Although the present invention is suitable for a wide scope of applications, it is particularly suitable for reducing the number of data lines and the number of data driver IC's.

2. Discussion of the Related Art

A liquid crystal display controls light transmittance of liquid crystals by using an electric field to display a picture. To this end, the liquid crystal display includes a liquid crystal display panel having a pixel matrix and a driving circuit for driving the liquid crystal display panel. The driving circuit drives the pixel matrix so that picture information can be displayed on the display panel.

FIG. 1 illustrates a related art liquid crystal display device.

Referring to FIG. 1, the related art liquid crystal display device includes a liquid crystal display panel 2, a data driver 4 driving a plurality of data lines DL1 to DLm of the liquid crystal display panel 2, a gate driver 6 driving a plurality of gate lines GL1 to GLn of the liquid crystal display panel.

The liquid crystal display panel 2 further includes a thin film transistor TFT formed at each intersection of the gate lines GL1 to GLn and the data line DL1 to DLm, and liquid crystal cells connected to the thin film transistors and arranged in a matrix.

The gate driver 6 sequentially applies gate signals to the gate lines GL1 to GLn in accordance with control signals from a timing controller (not shown). The data driver 4 converts data R, G, and B supplied from the timing controller into video signals as analog signals, and applies the video signals of one horizontal line portion to the data lines DL1 to DLm for each horizontal period when the gate signals are applied to the gate lines GL1 to GLn.

The thin film transistor TFT applies data from the data lines DL1 to DLm to the liquid crystal cells in response to the gate signals from the gate lines GL1 to GLn. The liquid crystal cell is composed of a pixel electrode connected to the TFT and a common electrode facing into each other with the liquid crystal therebetween, thus it can be expressed equivalent to a liquid crystal capacitor Clc. Such a liquid crystal cell includes a storage capacitor (not shown) connected to the previous gate line in order to sustain the data voltage charged in the liquid crystal capacitor Clc until the next data voltage is charged.

In this way, the liquid crystal cells of the related art liquid crystal display panel are located at intersections of the gate lines GL1 to GLn and the data lines DL1 to DLm, respectively. Thus, there are vertical lines formed as many as the data lines DL1 to DLm (i.e., m vertical lines). In other words, the liquid crystal cells are arranged in a matrix to form m vertical lines and n horizontal lines.

As can be seen here, the m data lines DL1 to DLm are required for driving the liquid crystal cells of the m horizontal lines. Accordingly, there is a disadvantage in that the processing time and fabricating cost are not efficient because a plurality of data lines DL1 to DLm are formed for driving the liquid crystal display panel 2 in the related art. Further, there is a problem in that the fabricating cost becomes high because a number of data driver IC's are required in the data driver 4 for driving each of the m data lines DL1 to DLm.

SUMMARY OF THE INVENTION

Accordingly, the present invention is directed to an apparatus and method for driving a liquid crystal display device that substantially obviates one or more of problems due to limitations and disadvantages of the related art.

Another object of the present invention is to provide an apparatus and method for driving a liquid crystal display device that is adaptive for reducing the number of data lines and the number of data driver IC's.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a plurality of data lines in a vertical direction, a plurality of gate lines in a horizontal direction to cross the data lines, and a plurality of liquid crystal cells along with each gate line, wherein one of the data lines applies a video signal to at least three liquid crystal cells.

Herein, the liquid crystal cells include a first liquid crystal cell, a second liquid crystal cell, and a third liquid crystal cell connected to the same data line and are adjacent to one another along with the horizontal line.

The liquid crystal display device further includes a first switching part connected to three of the gate lines for driving the first liquid crystal cell located in the $i^{th}$ horizontal line, wherein i is a natural number, a second switching part connected to two of the gate lines for driving the second liquid crystal cell located in the $i^{th}$ gate line, and a third switching part connected to one of the gate lines for driving the third liquid crystal cell located in the $i^{th}$ gate line.

Herein, the first switching part is connected to the $(i-1)^{th}$ gate line, the $i^{th}$ gate line, and the $(i+1)^{th}$ gate line, and applies the video signal supplied from the data lines to the first liquid crystal cell, wherein i is a natural number.

Herein, the first switching part applies the video signal to the first liquid crystal cell for the first ⅓ period of one horizontal period.

Herein, the second switching part is connected to the $(i-1)^{th}$ gate line and the $i^{th}$ gate line, and applies the video signal supplied from the data lines to the second liquid crystal cell, wherein i is a natural number.

Herein, the second switching part applies the video signal to the second liquid crystal cell for the second ⅓ period of one horizontal period.

Herein, the third switching part is connected to the $(i-1)^{th}$ gate line, and applies the video signal supplied from the data lines to the third liquid crystal cell.

Herein, the third switching part applies the video signal to the third liquid crystal cell for the third ⅓ period of one horizontal period.

Herein, the first liquid crystal cell, the second liquid crystal cell, and the third liquid crystal cell are arranged to be different from each other in a vertically adjacent position.

Herein, the second liquid crystal cell is located over the first liquid crystal cell, and the third liquid crystal cell is located below the second liquid crystal cell in the vertical direction.

Herein, the third liquid crystal cell is located over the first liquid crystal cell, and the second liquid crystal cell is located below the first liquid crystal cell in the vertical direction.

Herein, each of the first, second, and third liquid crystal cells includes at least one thin film transistor, and each of the thin film transistors includes a gate electrode on a substrate, a gate insulating layer on the gate electrode, a semiconductor layer on the gate insulating layer, a source electrode and a drain electrode on the semiconductor layer, and a protective layer on the source electrode and the drain electrode.

Herein, the semiconductor layer includes an undoped active layer on the gate insulating layer, and a doped ohmic contact layer on the undoped active layer.

Herein, the semiconductor layer, the source electrode, and the drain electrode are formed with the same mask.

Herein, the semiconductor layer, the source electrode, and the drain electrode are formed with different masks. Herein, the first, second, third, and fourth liquid crystal cells, which are connected to one of the data lines, are arranged adjacent to one another in the horizontal direction.

The liquid crystal display device further includes a first switching part connected to four of the gate lines for driving the first liquid crystal cell located in the $i^{th}$ gate line, wherein i is a natural number, a second switching part connected to three of the gate lines for driving the second liquid crystal cell located in the $i^{th}$ gate line, a third switching part connected to two of the gate lines for driving the third liquid crystal cell located in the $i^{th}$ gate line, and a fourth switching part connected to one of the gate lines for driving the fourth liquid crystal cell located in the $i^{th}$ gate line.

Herein, the first switching part is connected to the $(i-1)^{th}$ gate line, the $i^{th}$ gate line, the $(i+1)^{th}$ gate line, and the $(i+2)^{th}$ gate line, and applies the video signal supplied from the data lines to the first liquid crystal cell, wherein i is a natural number.

Herein, the first switching part applies the video signal to the first liquid crystal cell for the first ¼ period of one horizontal period.

Herein, the second switching part is connected to the $(i-1)^{th}$ gate line, the $i^{th}$ gate line, and the $(i+1)^{th}$ gate line and applies the video signal supplied from the data lines to the second liquid crystal cell, wherein i is a natural number.

Herein, the second switching part applies the video signal to the second liquid crystal cell for the second ¼ period of one horizontal period.

Herein, the third switching part is connected to the $(i-1)^{th}$ gate line and the $i^{th}$ gate line, and applies the video signal supplied from the data lines to the third liquid crystal cell, wherein i is a natural number.

Herein, the third switching part applies the video signal to the third liquid crystal cell for the third ¼ period of one horizontal period.

Herein, the fourth switching part is connected to the $(i-1)^{th}$ gate line, and applies the video signal supplied from the data lines to the fourth liquid crystal cell, wherein i is a natural number.

Herein, the fourth switching part applies the video signal to the fourth liquid crystal cell for the fourth ¼ period of one horizontal period.

Herein, the first, second, third, and fourth liquid crystal cells are arranged to be different from each other in a vertically adjacent position.

Herein, each of the first, second, third, and fourth liquid crystal cells includes at least one thin film transistor, and each of the thin film transistors includes a gate electrode on a substrate, a gate insulating layer on the gate electrode, a semiconductor layer on the gate insulating layer, a source electrode and a drain electrode on the semiconductor layer, and a protective layer on the source electrode and the drain electrode.

Herein, the semiconductor layer includes an undoped active layer on the gate insulating layer, and a doped ohmic contact layer on the undoped active layer.

Herein, the semiconductor layer, the source electrode, and the drain electrode are formed with the same mask.

Herein, the semiconductor layer, the source electrode, and the drain electrode are formed with different masks.

In another aspect of the present invention, a driving apparatus of a liquid crystal display device includes a plurality of data lines in a vertical direction, a plurality of gate lines in a horizontal direction to cross the data lines, a plurality of liquid crystal cells along with each gate line, switching parts adjacent to each of the liquid crystal cells for applying a video signal supplied from the data lines to at least three of the liquid crystal cells, a data driver applying the video signal to the data lines, and a gate driver applying a gate signal to the gate lines.

Herein, the switching parts applying the video signal supplied to one of the data lines to three of the liquid crystal cells include a first switching part connected to three of the gate lines for applying the video signal supplied from the data lines to the liquid crystal cell, a second switching part connected to two of the gate lines for applying the video signal supplied from the data lines to the liquid crystal cell, and a third switching part connected to one of the gate lines for applying the video signal supplied from the data lines to the liquid crystal cell.

Herein, the data driver sequentially applies three video signals to each data line for one horizontal period.

Herein, the data driver divides one horizontal period by three ⅓ periods to apply a first video signal to the first switching part for the first ⅓ period, to apply a second video signal to the second switching part for the second ⅓ period, and to apply a third video signal to the third switching part for the third ⅓ period.

Herein, the gate driver applies a first gate signal, a second gate signal, and a third gate signal to each of the gate lines.

Herein, the first gate signal remains at a high state for ⅓ of one horizontal period, the second gate signal remains at the high state for ⅔ of the one horizontal period, and the third gate signal remains at the high state for the one horizontal period.

Herein, the first, second, and third gate signals are applied to three gate lines to turn on the first switching part for the first ⅓ of one horizontal period.

Herein, the second and third gate signals are applied to two gate lines to turn on the second switching part for the second ⅓ of one horizontal period.

Herein, the third gate signal is applied to one gate line to turn on the third switching part for the third ⅓ of one horizontal period.

Herein, the switching parts applying the video signal supplied to one of the data lines to four of the liquid crystal cells include a first switching part connected to four of the gate lines for applying the video signal supplied to the data lines to the liquid crystal cell, a second switching part connected to three of the gate lines for applying the video signal supplied to the data lines to the liquid crystal cell, a third switching part connected to two of the gate lines for applying the video signal supplied to the data lines to the liquid crystal cell, and a fourth switching part connected to one of the gate lines for applying the video signal supplied to the data lines to the liquid crystal cell.

Herein, the data driver sequentially applies four video signals to each data line for one horizontal period.

Herein, the data driver divides one horizontal period by four ¼ periods to apply a first video signal to the first switching part for the first ¼ period, to apply a second video signal to the second switching part for the second ¼ period, to apply a third video signal to the third switching part for the third ¼ period, and to apply a fourth video signal to the fourth switching part for the fourth ¼ period.

Herein, the gate driver applies a first gate signal, a second gate signal, a third gate signal, and a fourth gate signal to each of the gate lines.

Herein, the first gate signal remains at a high state for ¼ of one horizontal period, the second gate signal remains at the high state for ⅔ of the one horizontal period, the third gate signal remains at the high state for ¾ of the one horizontal period, and the fourth gate signal remains at the high state for the one horizontal period.

Herein, the first, second, third, and fourth gate signals are applied to four gate lines to turn on the first switching part for the first ¼ of one horizontal period.

Herein, the second, third, and fourth gate signals are applied to three gate lines to turn on the second switching part for the second ¼ of one horizontal period.

Herein, the third and fourth gate signals are applied to two gate lines to turn on the third switching part for the third ¼ of one horizontal period.

Herein, the fourth gate signal is applied to one gate line to turn on the fourth switching part for the fourth ¼ of one horizontal period.

In another aspect of the present invention, a method of driving a liquid crystal display device having a plurality of liquid crystal cells along with gate lines includes applying i, wherein i is a natural number not less than 3, or more video signals to each data line for one horizontal period, and applying the i or more video signals supplied to the data line to i liquid crystal cells along with the gate lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 2:
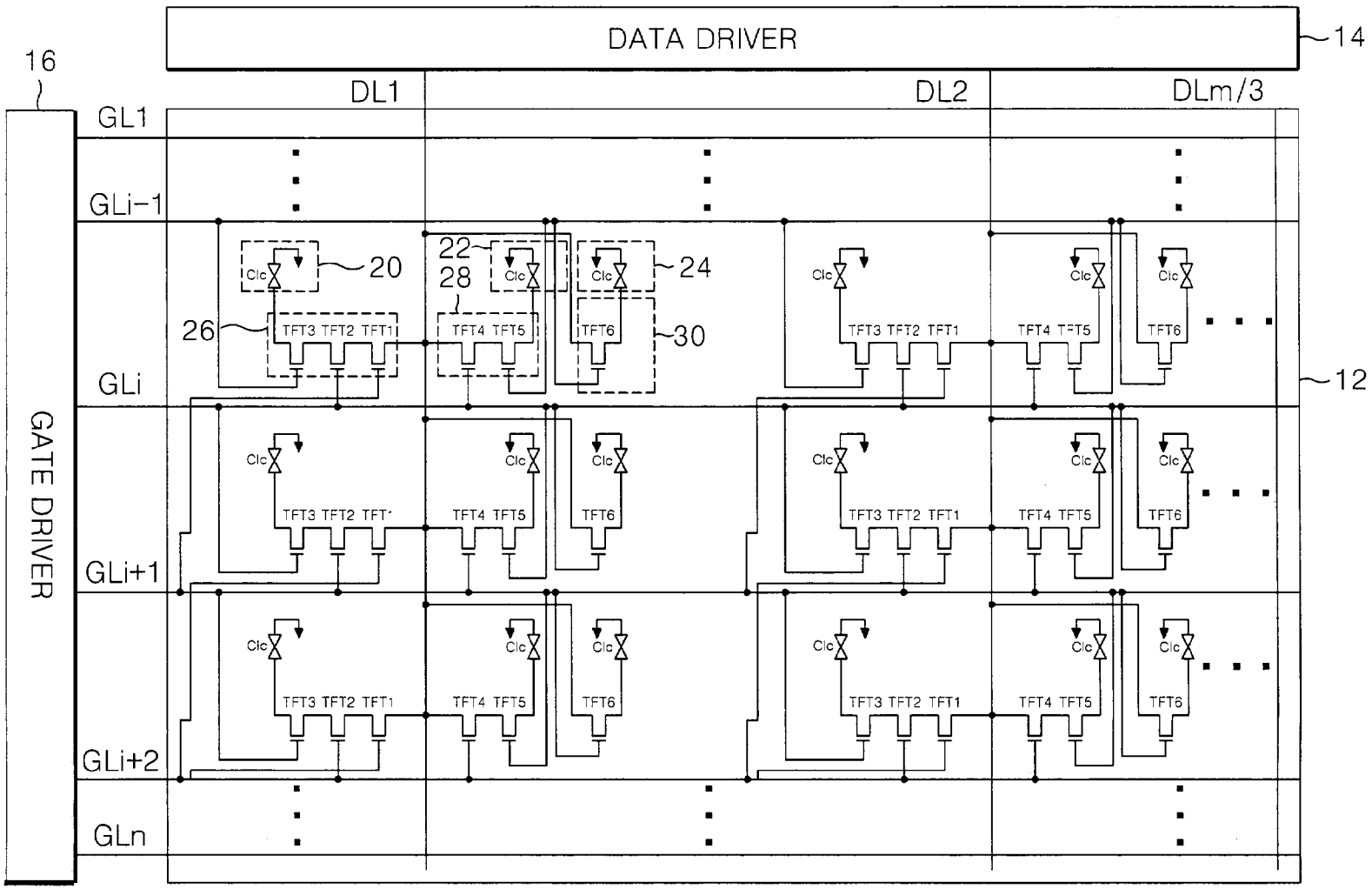
FIG. 2 illustrates a schematic diagram of a liquid crystal display device according to a first embodiment of the present invention.

FIG. 2 illustrates a schematic diagram of a liquid crystal display device according to a first embodiment of the present invention.

Referring to FIG. 2, the liquid crystal display device according to the first embodiment of the present invention includes a liquid crystal display panel 12, a data driver 14 driving first data lines DL1 to DLm/3 of the liquid crystal display panel 12, and a gate driver 16 driving gate lines GL1 to GLn of the liquid crystal display panel 12.

The liquid crystal display panel 12 includes a first liquid crystal cell 20, a second liquid crystal cell 22, and a third liquid crystal cell 24 formed at each intersection of the gate lines GL1 to GLn and the data lines DL1 to DLm/3, a first switching part 26 driving the first liquid crystal cell 20, a second switching part 28 driving the second liquid crystal cell 22, and a third switching part 30 driving the third liquid crystal cell 24.

The first to third liquid crystal cells 20 to 24 are each composed of a pixel electrode connected to the first to third switching parts 26 to 30, respectively, and a common electrode facing into each other with the liquid crystal therebetween, thus they can be expressed equivalent to a liquid crystal capacitor Clc. Further, the first to third liquid crystal cells 20 to 24 include storage capacitors (not shown) connected to the previous gate line in order to sustain the data voltage charged in the liquid crystal capacitor Clc until the next data voltage is charged.

Figure 1:
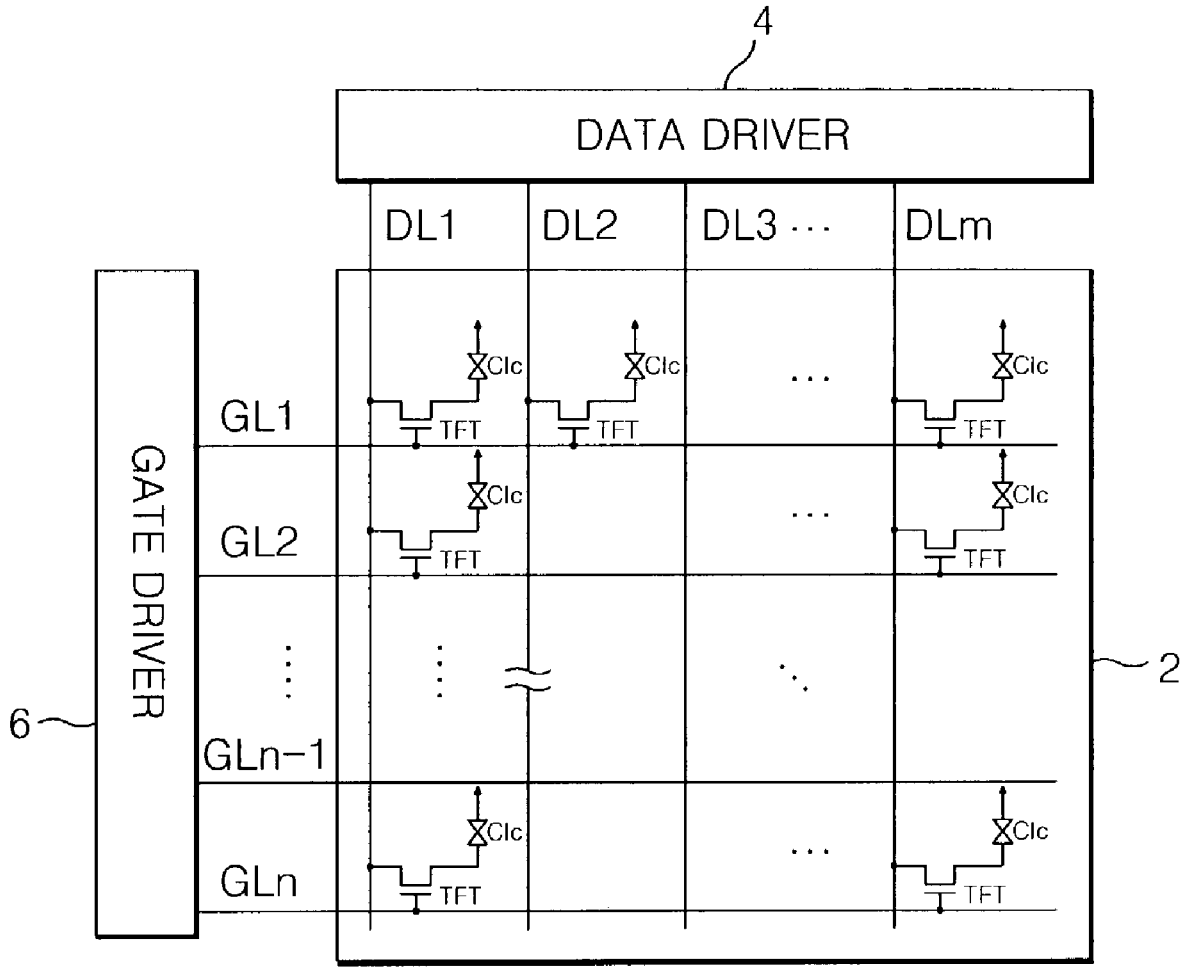
FIG. 1 RELATED ART
FIG. 1 illustrates a schematic diagram of a related art liquid crystal display device.

The first liquid crystal cell 20, the second liquid crystal cell 22, and the third liquid crystal cell 24 are sequentially arranged along with horizontal lines. In other words, the liquid crystal cells along with the horizontal lines are arranged in the order of the first liquid crystal cell 20, the second liquid crystal cell 22, the third liquid crystal cell 24, the first liquid crystal cell 20, the second liquid crystal cell 22, the third liquid crystal cell 24, and so on. Herein, the first liquid crystal cell 20, the second liquid crystal cell 22, and the third liquid crystal cell 24, which are located adjacent to one another, receive video signals from one of the data lines DL. Therefore, in the liquid crystal display device according to the first embodiment of the present invention, the number of data lines DL is reduced to ⅓ as compared to the related art liquid crystal display device shown in FIG. 1.

Figure 4:
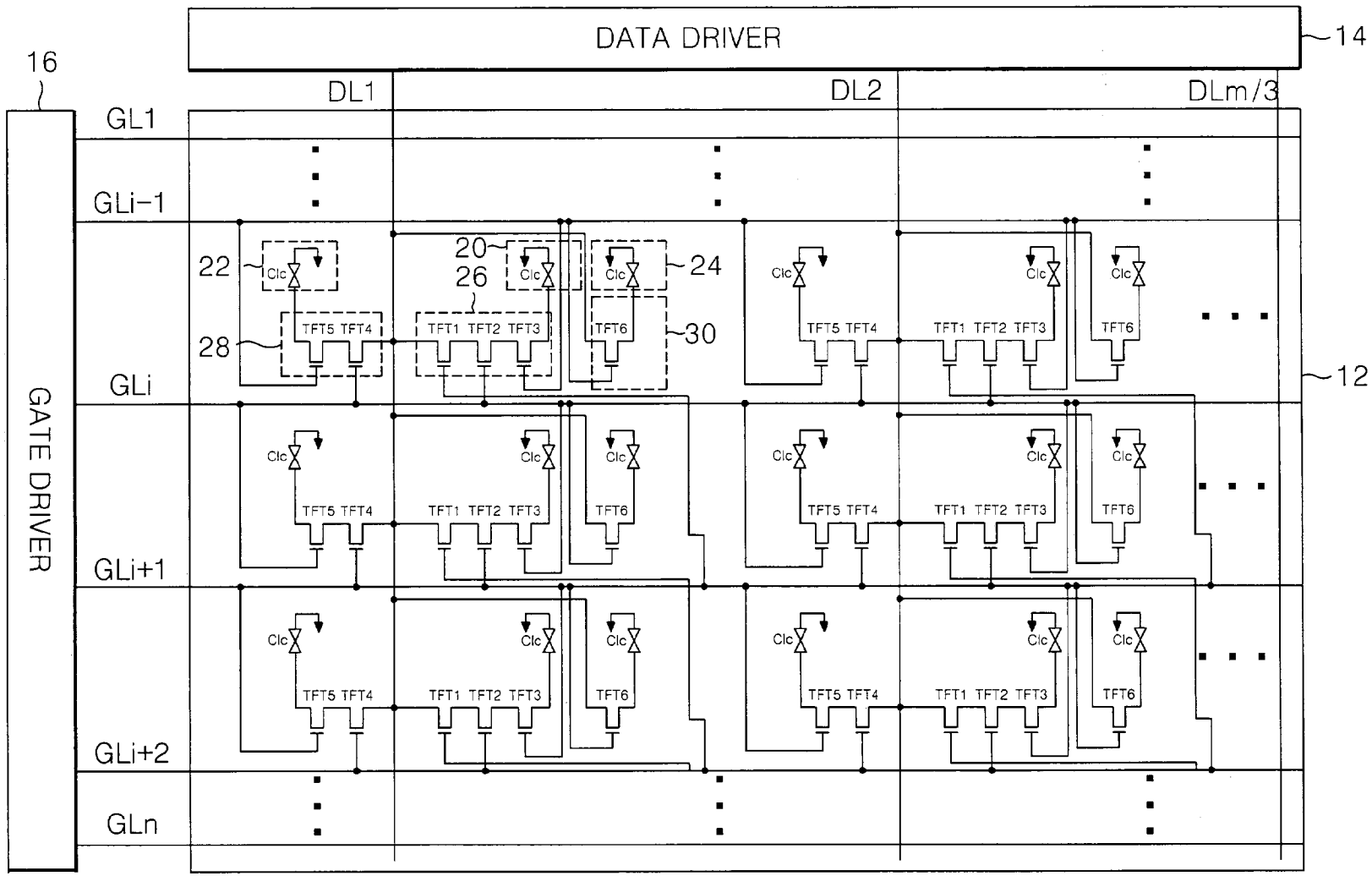
FIG. 4 illustrates a schematic diagram of a liquid crystal display device according to another embodiment of FIG. 2.

Alternatively, the locations of the first liquid crystal cell 20, the second liquid crystal cell 22, and the third liquid crystal cell 24 may be varied in the present invention. For example, the liquid crystal cells can be arranged in the order of the second liquid crystal cell 22, the first liquid crystal cell 20, the third liquid crystal cell 24, and so on, along with the horizontal lines, as shown in FIG. 4. In other words, the first to third liquid crystal cells 20 to 24 may be varied to be adjacent to each other along with the horizontal lines. Herein, the first liquid crystal cell 20, the second liquid crystal 22, and the third liquid crystal cell 24 located adjacent to one another receive video signals from one of the data lines DL.

The first switching part 26 driving the first liquid crystal cell 20 located adjacent to the $i^{th}$ horizontal line includes a first thin film transistor TFT1 to a third thin film transistor TFT3. The first thin film transistor TFT1 has its source terminal connected to the adjacent data line DL and its gate terminal connected to the $(i+1)^{th}$ gate line GLi+1. The second thin film transistor TFT2 has its gate terminal connected to the $i^{th}$ gate line GLi and its source terminal connected to the drain terminal of the first thin film transistor TFT1. The third thin film transistor TFT3 has its gate terminal connected to the $(i-1)^{th}$ gate line GLi−1 and its source terminal connected to the drain terminal of the second thin film transistor TFT2. And, the drain terminal of the third thin film transistor TFT3 is connected to the first liquid crystal cell 20. In this way, the first switching part 26 applies the video signal from the date line DL to the first liquid crystal cell 20, when a driving signal (i.e., gate signal) is applied to the $(i-1)^{th}$ gate line GLi−1, the $i^{th}$ gate line GLi, and the $(i+1)^{th}$ gate line GLi+1.

The second switching part 28 driving the second liquid crystal cell 22 located adjacent to the $i^{th}$ horizontal line includes a fourth thin film transistor TFT4 and a fifth thin film transistor TFT5. The fourth thin film transistor TFT4 has its source terminal connected to the adjacent data line DL and its gate terminal connected to the $i^{th}$ gate line GLi. The fifth thin film transistor TFT5 has its gate terminal connected to the $(i-1)^{th}$ gate line GLi−1 and its source terminal connected to the drain terminal of the fourth thin film transistor TFT4. And, the drain terminal of the fifth thin film transistor TFT5 is connected to the second liquid crystal cell 22. In this way, the second switching part 28 applies the video signal from the data line DL to the second liquid crystal cell 22, when a driving signal (i.e., gate signal) is applied to the $(i-1)^{th}$ gate line GLi−1 and the $i^{th}$ gate line GLi.

The third switching part 30 driving the third liquid crystal cell 24 located adjacent to the $i^{th}$ horizontal line includes a sixth thin film transistor TFT6. The sixth thin film transistor TFT6 has its source terminal connected to the adjacent data line DL and its gate terminal connected to the $(i-1)^{th}$ gate line GLi−1. And, the drain terminal of the sixth thin film transistor TFT6 is connected to the third liquid crystal cell 24. In this way, the third switching part 30 applies the video signal from the data line DL to the third liquid crystal cell 24, when a driving signal (i.e., gate signal) is applied to the $(i-1)^{th}$ gate line GLi−1.

The data driver 14 converts data R, G, and B supplied from the timing controller (not shown) into video signals as analog signals and applies to the data lines DL1 to DLm/3. In this way, the data driver 14 sequentially applies three of the video signals to each of the data lines DL for one horizontal period.

Figure 3:
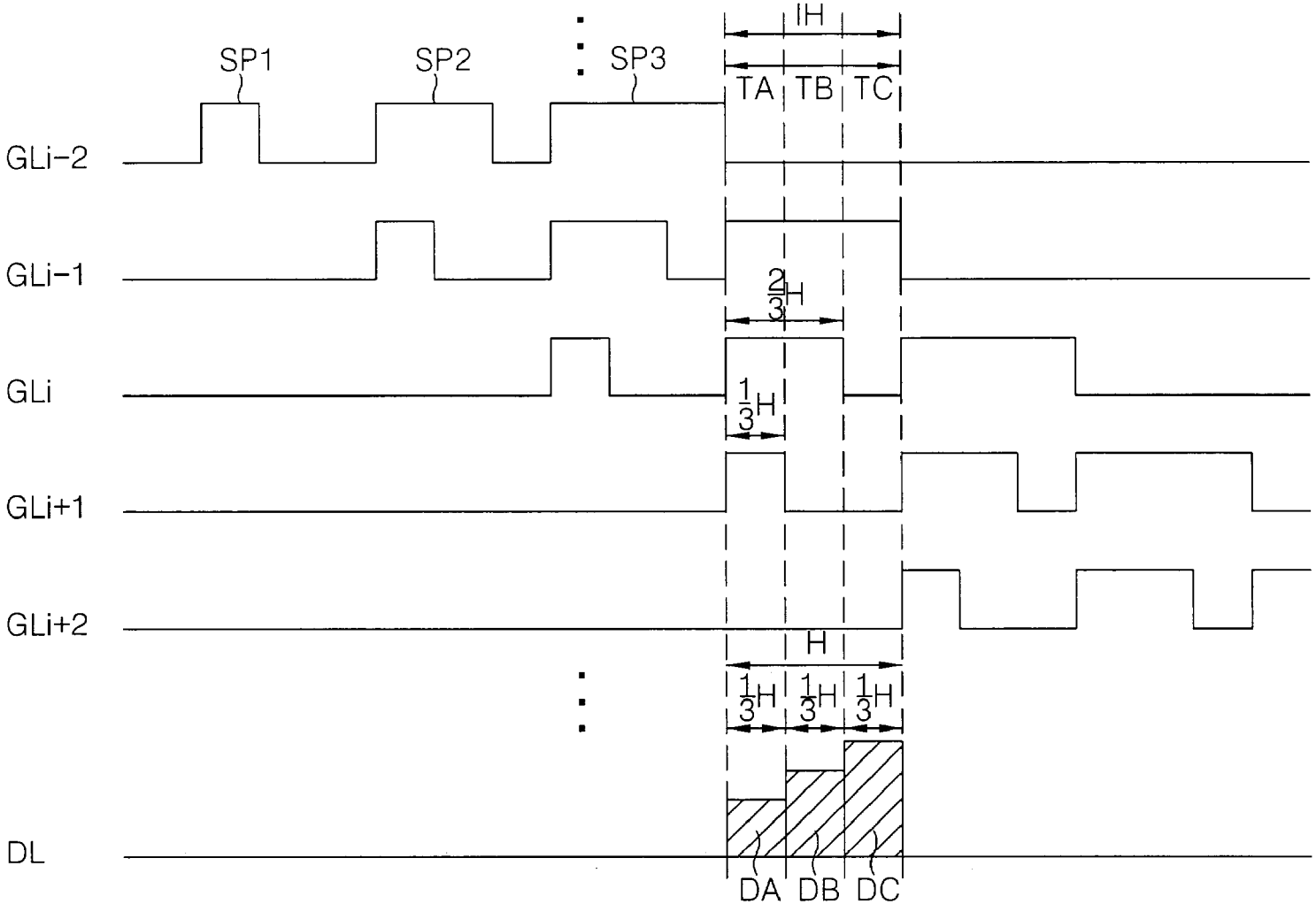
FIG. 3 is a waveform diagram illustrating gate signals applied to the gate lines for driving the liquid crystal cells shown in FIG. 2.

To describe this in detail with reference to FIG. 3, the data driver 14 sequentially applies a first video signal DA, a second video signal DB, and a third video signal DC to each of the data lines DL for one horizontal period 1H. Herein, the first video signal DA is applied to the first liquid crystal cell 20, the second video signal DB is applied to the second liquid crystal cell 22, and the third video signal DC is applied to the third liquid crystal cell 24. On the other hand, the data driver 14 applies each of the video signals DA, DB, and DC for ⅓ of a period ⅓H, so that the three video signals DA, DB, and DC can be applied for one horizontal period. In other words, the data driver 14 of the present invention applies the three video signals to each of the data lines DL for one horizontal period. Accordingly, the data driver 14 of the present invention only requires data driver IC's corresponding to ⅓ of the number of data driver IC's of the related art liquid crystal display device shown in FIG. 1, thereby reducing its fabricating cost.

The gate driver 16, as shown in FIG. 3, applies a first gate signal SP1, a second gate signal SP2, and a third gate signal SP3 to each of the gate lines GL1 to GLn in accordance with control signals applied from the timing controller (not shown). Herein, the third gate signal SP3 remains at a high state for one horizontal period, the second gate signal SP2 remains at the high state for ⅔ of the one horizontal period, and the first gate signal SP1 remains at the high state for ⅓ of the one horizontal period.

The third gate signal SP3 is applied to the $(i-1)^{th}$ gate line GLi−1, the second gate signal SP2 is applied to the $i^{th}$ gate line GLi, and the first gate signal SP1 is applied to the $(i+1)^{th}$ gate line GLi+1, at the same time. Accordingly, the third gate signal SP3 applied to the $(i-1)^{th}$ gate line GLi−1 overlaps the second gate signal SP2 applied to the $i^{th}$ gate line GLi and the first gate signal SP1 applied to the $(i+1)^{th}$ gate line GLi+1 for a first period TA (i.e., ⅓H).

During a second period TB subsequent to the first period TA (i.e., ⅔H), the third gate signal SP3 applied to the $(i-1)^{th}$ gate line GLi−1 overlaps the second gate signal SP2 applied to the $i^{th}$ gate line GLi. Then, during a third period TC subsequent to the second period TB, the third gate signal SP3 is only applied to the $(i-1)^{th}$ gate line GLi−1.

To describe in detail a process that video signals are applied to the liquid crystal cells 20, 22, and 24 located adjacent to the $i^{th}$ horizontal line, for the first period TA, the third gate signal SP3 is applied to the $(i-1)^{th}$ gate line GLi−1, the second gate signal SP2 is applied to the $i^{th}$ gate line GLi, and the first gate signal SP1 is applied to the $(i+1)^{th}$ gate line GLi+1, at the same time. The third gate signal SP3 applied to the $(i-1)^{th}$ gate line GLi−1 turns on the third thin film transistor TFT3. The second gate signal SP2 applied to the $i^{th}$ gate line GLi turns on the second thin film transistor TFT2. And, the first gate signal SP1 applied to the $(i+1)^{th}$ gate line GLi+1 turns on the first thin film transistor TFT1. Accordingly, the first video signal DA applied to the data line DL for the first period TA is applied to the first liquid crystal cell 20 through the first to third thin film transistor TFT1 to TFT3.

For the second period TB, the third gate signal SP3 is applied to the $(i-1)^{th}$ gate line GLi−1 and the second gate signal SP2 is applied to the $i^{th}$ gate line GLi. The third gate signal SP3 applied to the $(i-1)^{th}$ gate line GLi−1 turns on the fifth thin film transistor TFT5. The second gate signal SP2 applied to the $i^{th}$ gate line GLi turns on the fourth thin film transistor TFT4. Accordingly, the second video signal DB applied to the data line DL for the second period TB is applied to the second liquid crystal cell 22 through the fourth and fifth thin film transistors TFT4 and TFT5.

For the third period TC, the third gate signal SP3 is applied to the $(i-1)^{th}$ gate line GLi−1. The third gate signal SP3 applied to the $(i-1)^{th}$ gate line GLi−1 turns on the sixth thin film transistor TFT6. Accordingly, the third video signal DC applied to the data line DL for the third period TC is applied to the third liquid crystal cell 24 through the sixth thin film transistor TFT6.

On the other hand, the second liquid crystal cell 22 substantially receives the first video signal DA for the first period TA. Since the second liquid crystal cell 22 receives the second video signal DB during the second period TB subsequent to the first period TA, a desired video signal DB can be charged. Further, the third liquid crystal cell 24 receives the first and second video signals DA and DB for the first and second periods TA and TB, respectively. However, the third liquid crystal cell 24 can be charged with a desired video signal because the third video signal DC is applied during the third period TC subsequent to the second period TB.

Figure 5:
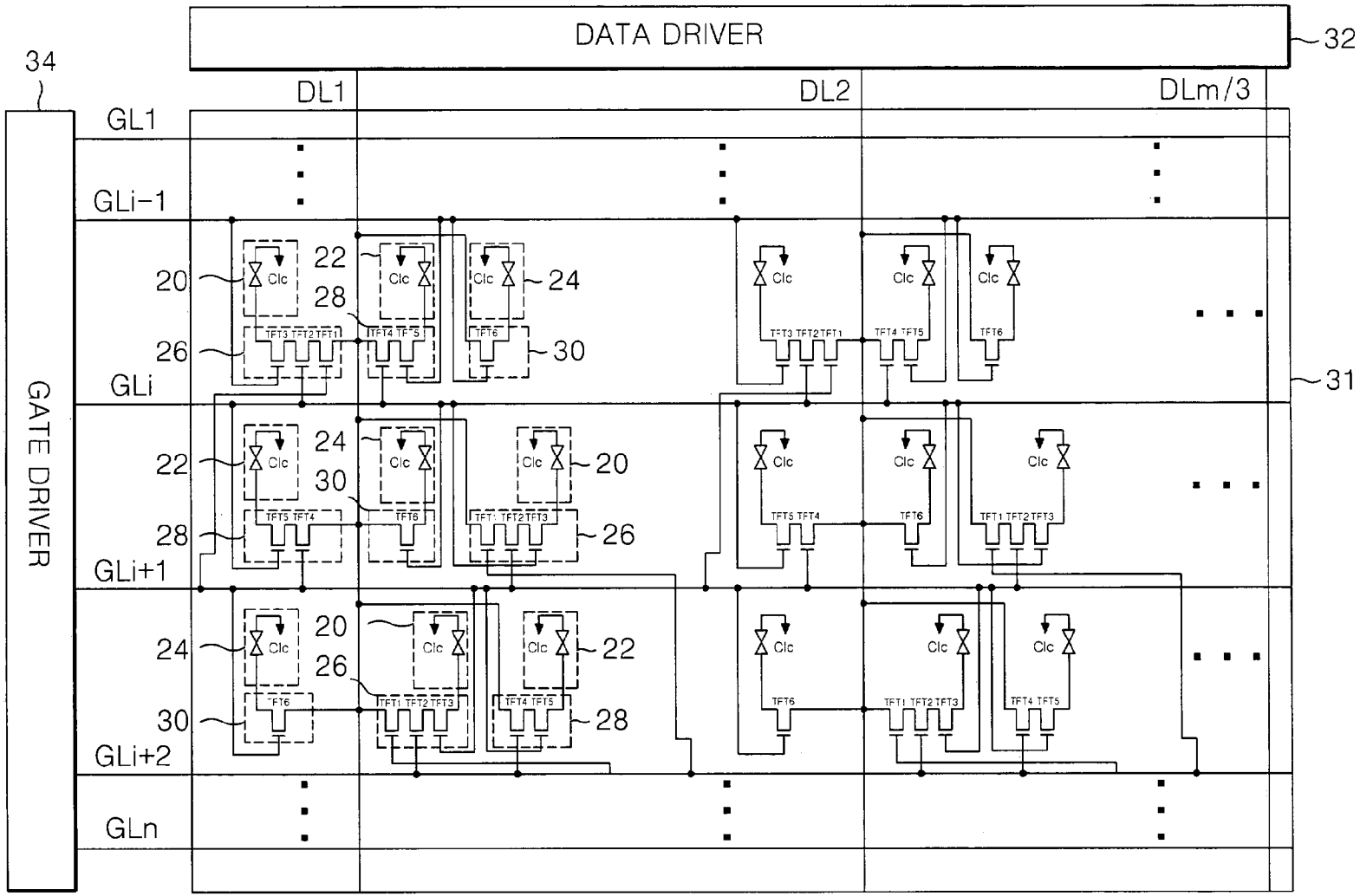
FIG. 5 illustrates a schematic diagram of a liquid crystal display device according to a second embodiment of the present invention.

FIG. 5 illustrates a schematic diagram of a liquid crystal display device according to a second embodiment of the present invention.

The second embodiment of the present invention is similar to the first embodiment, except for the locations where the liquid crystal cells 20, 22, and 24 and the switching parts 26, 28, and 30 are formed. The liquid crystal display device of the second embodiment can be functioned the same as that of the first embodiment of the present invention in FIG. 2.

Referring to FIG. 5, the liquid crystal display device according to the second embodiment of the present invention includes a liquid crystal display panel 31, a data driver 32 driving first data lines DL1 to DLm/3 of the liquid crystal display panel 31, and a gate driver 34 driving gate lines GL1 to GLn of the liquid crystal display panel 31.

The liquid crystal display panel 31 includes a first liquid crystal cell 20, a second liquid crystal cell 22, and a third liquid crystal cell 24 formed at each intersection of the gate lines GL1 to GLn and the data lines DL1 to DLm/3, a first switching part 26 formed adjacent to the first liquid crystal cell 20 driving the first liquid crystal cell 20, a second switching part 28 formed adjacent to the second liquid crystal cell 22 driving the second liquid crystal cell 22, and a third switching part 30 formed adjacent to the third liquid crystal cell 24 driving the third liquid crystal cell 24.

The first to third liquid crystal cells 20 to 24 are each composed of a pixel electrode connected to the first to third switching parts 26 to 30, respectively, and a common electrode facing into each other with the liquid crystal therebetween, thus they can be expressed equivalent to a liquid crystal capacitor Clc. Further, the first to third liquid crystal cells 20 to 24 include storage capacitors (not shown) connected to the previous gate line in order to sustain the data voltage charged in the liquid crystal capacitor Clc until the next data voltage is charged.

The first liquid crystal cell 20, the second liquid crystal cell 22, and the third liquid crystal cell 24 are sequentially arranged along with the $i^{th}$ horizontal line. In other words, the liquid crystal cells along with the $i^{th}$ horizontal line are arranged in the order of the first liquid crystal cell 20, the second liquid crystal cell 22, the third liquid crystal cell 24, the first liquid crystal cell 20, the second liquid crystal cell 22, the third liquid crystal cell 24, and so on. In the $(i+1)^{th}$ horizontal line, the liquid crystal cells are arranged in the order of the second liquid crystal cell 22, the third liquid crystal cell 24, and the first liquid crystal cell 20. And, in the $(i+2)^{th}$ horizontal line, the liquid crystal cells are arranged in the order of the third liquid crystal cell 24, the first liquid crystal cell 20, and the second liquid crystal cell 22.

Accordingly, along with the $j^{th}$ (wherein, j is a natural number) vertical line, the liquid crystal cells are arranged in the order of the first liquid crystal cell 20, the second liquid crystal cell 22, and the third liquid crystal cell 24. Along with the $(j+1)^{th}$ vertical line, the liquid crystal cells are arranged in the order of the second liquid crystal cell 22, the third liquid crystal cell 24, and the first liquid crystal cell 20. And, along with the $(j+2)^{th}$ vertical line, the liquid crystal cells are arranged in the order of the third liquid crystal cell 24, the first liquid crystal cell 20, and the second liquid crystal cell 22. In other words, in the second embodiment of the present invention, the liquid crystal cells located in a specific horizontal line have liquid crystal cells different from each other located in the vertically adjacent positions. In this way, if the liquid crystal cells different from each other are located in the vertically adjacent positions, an image of uniform quality can be displayed on the panel, even if there occurs inequality in the voltage charge among liquid crystal cells 20, 22, and 24. This is because the value of inequality is set-off by the horizontal line.

On the other hand, the first liquid crystal cell 20, the second liquid crystal cell 22, and the third liquid crystal cell 24 are located adjacent to one another receive video signals from one of data lines DL. Therefore, in the liquid crystal display device according to the second embodiment of the present invention, the number of data lines DL is reduced to ⅓ as compared to the related art liquid crystal display device in FIG. 1.

The first switching part 26 driving the first liquid crystal cell 20 that is located along with the $i^{th}$ horizontal line includes a first thin film transistor TFT1 to a third thin film transistor TFT3. The first thin film transistor TFT1 has its source terminal connected to the adjacent data line DL and its gate terminal connected to the $(i+1)^{th}$ gate line GLi+1. The second thin film transistor TFT2 has its gate terminal connected to the $i^{th}$ gate line GLi and its source terminal connected to the drain terminal of the first thin film transistor TFT1. The third thin film transistor TFT3 has its gate terminal connected to the $(i-1)^{th}$ gate line GLi−1 and its source terminal connected to the drain terminal of the second thin film transistor TFT2. And, the drain terminal of the third thin film transistor TFT3 is connected to the first liquid crystal cell 20. In this way, the first switching part 26 applies the video signal from the data line DL to the first liquid crystal cell 20 when a driving signal (i.e., gate signal) is applied to the $(i-1)^{th}$ gate line GLi−1, the $i^{th}$ gate line GLi, and the $(i+1)^{th}$ gate line GLi+1.

The second switching part 28 driving the second liquid crystal cell 22 located along with the $i^{th}$ horizontal line includes a fourth thin film transistor TFT4 and a fifth thin film transistor TFT5. The fourth thin film transistor TFT4 has its source terminal connected to the adjacent data line DL and its gate terminal connected to the $i^{th}$ gate line GLi. The fifth thin film transistor TFT5 has its gate terminal connected to the $(i-1)^{th}$ gate line GLi−1 and its source terminal connected to the drain terminal of the fourth thin film transistor TFT4. And, the drain terminal of the fifth thin film transistor TFT5 is connected to the second liquid crystal cell 22. In this way, the second switching part 28 applies the video signal from the data line DL to the second liquid crystal cell 22 when a driving signal (i.e., gate signal) is applied to the $(i-1)^{th}$ gate line GLi−1 and the $i^{th}$ gate line GLi.

The third switching part 30 driving the third liquid crystal cell 24 located along with the $i^{th}$ horizontal line includes a sixth thin film transistor TFT6. The sixth thin film transistor TFT6 has its source terminal connected to the adjacent data line DL and its gate terminal connected to the $(i-1)^{th}$ gate line GLi−1. And, the drain terminal of the sixth thin film transistor TFT6 is connected to the third liquid crystal cell 24. In this way, the third switching part 30 applies the video signal from the data line DL to the third liquid crystal cell 24 when a driving signal (i.e., gate signal) is applied to the $(i-1)^{th}$ gate line GLi−1.

The data driver 32 converts data R, G, and B supplied from the timing controller (not shown) into video signals as analog signals and applies to the data lines DL1 to DLm/3. In this way, the data driver 32 sequentially applies three of the video signals to each of the data lines DL for one horizontal period.

To describe this in detail with reference to FIG. 3, the data driver 32 of FIG. 5 sequentially applies a first video signal DA, a second video signal DB, and a third video signal DC to each of the data lines DL for one horizontal period 1H. Herein, the first video signal DA is applied to the first liquid crystal cell 20, the second video signal DB is applied to the second liquid crystal cell 22, and the third video signal DC is applied to the third liquid crystal cell 24. On the other hand, the data driver 32 applies each of the video signals DA, DB, and DC for ⅓ of a period ⅓H, so that the three video signals DA, DB, and DC can be applied for one horizontal period. In other words, the data driver 32 of the present invention applies the three video signals to each of the data lines DL for one horizontal period. Accordingly, the data driver 32 of the present invention requires only data driver IC's corresponding to ⅓ of the number of data driver IC's of the related art liquid crystal display device shown in FIG. 1, thereby reducing its fabricating cost.

The gate driver 34 of FIG. 5 applies a first gate signal SP1, a second gate signal SP2, and a third gate signal SP3 to each of the gate lines GL1 to GLn+1 in accordance with control signals applied from the timing controller (not shown) as shown in FIG. 3. Herein, the third gate signal SP3 remains at a high state for one horizontal period, the second gate signal SP2 remains at the high state for ⅔ of the one horizontal period, and the first gate signal SP1 remains at the high state for ⅓ of the one horizontal period.

The third gate signal SP3 is applied to the $(i-1)^{th}$ gate line GLi−1, the second gate signal SP2 is applied to the $i^{th}$ gate line GLi, and the first gate signal SP1 is applied to the $(i+1)^{th}$ gate line GLi+1 at the same time. Accordingly, the third gate signal SP3 applied to the $(i-1)^{th}$ gate line GLi−1 overlaps with the second gate signal SP2 applied to the $i^{th}$ gate line GLi and the first gate signal SP1 applied to the $(i+1)^{th}$ gate line GLi+1 for a first period TA (i.e., ⅓H).

During the second period TB subsequent to the first period TA (i.e., ⅔H), the third gate signal SP3 applied to the $(i-1)^{th}$ gate line GLi−1 overlaps with the second gate signal SP2 applied to the $i^{th}$ gate line GLi. Then, during the third period TC subsequent to the second period TB, the third gate signal SP3 is only applied to the $(i-1)^{th}$ gate line GLi−1.

To describe in detail a process that video signals are applied to the liquid crystal cells 20, 22, and 24 located in the $i^{th}$ horizontal line, for the first period TA, the third gate signal SP3 is applied to the $(i-1)^{th}$ gate line GLi−1, the second gate signal SP2 is applied to the $i^{th}$ gate line GLi, and the first gate signal SP1 is applied to the $(i+1)^{th}$ gate line GLi+1, at the same time. The third gate signal SP3 applied to the $(i-1)^{th}$ gate line GLi−1 turns on the third thin film transistor TFT3. The second gate signal SP2 applied to the $i^{th}$ gate line GLi turns on the second thin film transistor TFT2. And, the first gate signal SP1 applied to the $(i+1)^{th}$ gate line GLi+1 turns on the first thin film transistor TFT1. Accordingly, the first video signal DA applied to the data line DL for the first period TA is applied to the first liquid crystal cell 20 through the first to third thin film transistor TFT1 to TFT3.

For the second period TB, the third gate signal SP3 is applied to the $(i-1)^{th}$ gate line GLi−1, and the second gate signal SP2 is applied to the $i^{th}$ gate line GLi. The third gate signal SP3 applied to the $(i-1)^{th}$ gate line GLi−1 turns on the fifth thin film transistor TFT5. The second gate signal SP2 applied to the $i^{th}$ gate line GLi turns on the fourth thin film transistor TFT4. Accordingly, the second video signal DB applied to the data line DL for the second period TB is applied to the second liquid crystal cell 22 through the fourth and fifth thin film transistors TFT4 and TFT5.

For the third period TC, the third gate signal SP3 is applied to the $(i-1)^{th}$ gate line GLi−1. The third gate signal SP3 applied to the $(i-1)^{th}$ gate line GLi−1 turns on the sixth thin film transistor TFT6. Accordingly, the third video signal DC applied to the data line DL for the third period TC is applied to the third liquid crystal cell 24 through the sixth thin film transistor TFT6.

On the other hand, the second liquid crystal cell 22 in fact receives the first video signal DA for the first period TA. However, since the second liquid crystal cell 22 receives the second video signal DB during the second period TB subsequent to the first period TA, a desired video signal DB can be charged. Further, the third liquid crystal cell 24 receives the first and second video signals DA and DB for the first and second periods TA and TB, respectively. However, the third liquid crystal cell 24 can be charged with the desired video signal because the third video signal DC is applied during the third period TC subsequent to the second period TB.

Figure 6:
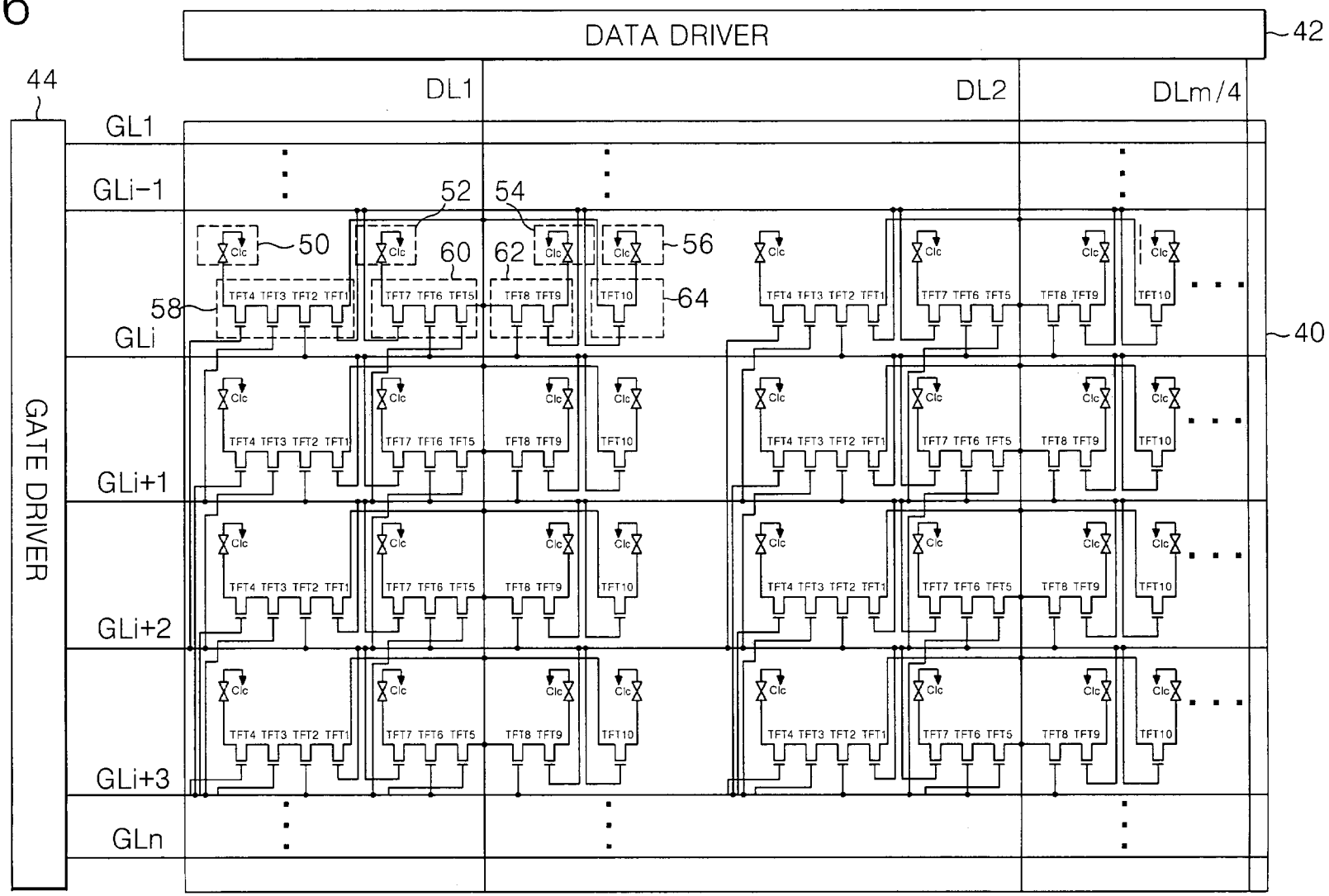
FIG. 6 illustrates a schematic diagram of a liquid crystal display device according to a third embodiment of the present invention.

FIG. 6 illustrates a liquid crystal display device according to a third embodiment of the present invention.

Referring to FIG. 6, the liquid crystal display device according to the third embodiment of the present invention includes a liquid crystal display panel 40, a data driver 42 driving first data lines DL1 to DLm/4 of the liquid crystal display panel 40, and a gate driver 44 driving gate lines GL1 to GLn of the liquid crystal display panel 40.

More specifically, the liquid crystal display panel 40 includes a plurality of first liquid crystal cells 50, a plurality of second liquid crystal cells 52, a plurality of third liquid crystal cells 54, and a plurality of fourth liquid crystal cells 56 formed at the intersections of the gate lines GL1 to GLn and the data lines DL1 to DLm/4, a first switching part 58 formed adjacent to the first liquid crystal cell 50 driving the first liquid crystal cell 50, a second switching part 60 formed adjacent to the second liquid crystal cell 52 driving the second liquid crystal cell 52, a third switching part 62 formed adjacent to the third liquid crystal cell 54 driving the third liquid crystal cell 54, and a fourth switching part 64 formed adjacent to the fourth liquid crystal cell 56 driving the third liquid crystal cell 56.

The first to fourth liquid crystal cells 50 to 56 are each composed of a pixel electrode connected to the first to fourth switching parts 58 to 64, respectively, and a common electrode facing into each other with the liquid crystal therebetween, thus they can be expressed equivalent to a liquid crystal capacitor Clc. Further, the first to fourth liquid crystal cells 50 to 56 include storage capacitors (not shown) connected to the previous gate line in order to sustain the data voltage charged in the liquid crystal capacitor Clc until the next data voltage is charged.

The first liquid crystal cell 50, the second liquid crystal cell 52, the third liquid crystal cell 54, and the fourth liquid crystal cell 56 are sequentially arranged along with a horizontal line. In other words, the liquid crystal cells in the horizontal line are arranged in the order of the first liquid crystal cell 50, the second liquid crystal cell 52, the third liquid crystal cell 54, the fourth liquid crystal cell 56, and so on. Herein, the first liquid crystal cell 50, the second liquid crystal cell 52, the third liquid crystal cell 54, and the fourth liquid crystal cell 56, which are located adjacent to one another, receive video signals from one of the data lines DL. Therefore, in the liquid crystal display device according to the third embodiment of the present invention, the number of data lines DL is reduced to ¼ as compared to the related art liquid crystal display device shown in FIG. 1.

On the other hand, the locations of the first liquid crystal cell 50, the second liquid crystal cell 52, the third liquid crystal cell 54, and the fourth liquid crystal cell 56 may be varied in the present invention. For example, the liquid crystal cells can be arranged in the order of the second liquid crystal cell 52, the first liquid crystal cell 50, the third liquid crystal cell 54, the fourth liquid crystal cell 56, and so on along with the horizontal lines. In other words, the first to fourth liquid crystal cells 50 to 56 can be arranged to be adjacent to each other along with the horizontal lines.

Further, the first liquid crystal cell 50, the second liquid crystal cell 52, the third liquid crystal cell 54, and the fourth liquid crystal cell 56 can be alternatively arranged with respect to the data line DL located adjacent thereto. For instance, along with the $i^{th}$ horizontal line, the liquid crystal cells are arranged in the order of the first liquid crystal cell 50, the second liquid crystal cell 52, the third liquid crystal cell 54, and the fourth liquid crystal cell 56. Along with the $(i+1)^{th}$ horizontal line, the liquid crystal cells are arranged in the order of the third liquid crystal cell 54, the fourth liquid crystal cell 56, the first liquid crystal cell 50, and the second liquid crystal cell 52. In the same manner, the liquid crystal cells 50, 52, 54, and 56 can be alternatively arranged with respect to each horizontal line. On the other hand, the locations of the liquid crystal cells 50, 52, 54, and 56 can be variously changed in the present invention.

For instance, along with the $j^{th}$ vertical line, the liquid crystal cells are arranged in the order of the first liquid crystal cell 50, the second liquid crystal cell 52, the third liquid crystal cell 54, and the fourth liquid crystal cell 56. Along with the $(j+1)^{th}$ vertical line, the liquid crystal cells are arranged in the order of the second liquid crystal cell 52, the third liquid crystal cell 54, the fourth liquid crystal cell 56, and the first liquid crystal cell 50. Along with the $(j+2)^{th}$ vertical line, the liquid crystal cells are arranged in the order of the third liquid crystal cell 54, the fourth liquid crystal cell 56, the first liquid crystal cell 50, and the second liquid crystal cell 52. Along with the $(j+3)^{th}$ vertical line, the liquid crystal cells are arranged in the order of the fourth liquid crystal cell 56, the first liquid crystal cell 50, the second liquid crystal cell 52, and the third liquid crystal cell 54. In this way, if the liquid crystal cells different from each other are arranged in the vertically adjacent liquid crystal cells 50, 52, 54, and 56, even when there occurs inequality in the voltage charge among liquid crystal cells 50, 52, 54, and 56, an image of uniform picture quality can be displayed on the panel. This is because the value of inequality is set-off by the horizontal line.

The first switching part 58 driving the first liquid crystal cell 50 that is located along with the $i^{th}$ horizontal line includes a first thin film transistor TFT1 to a four thin film transistor TFT4. The first thin film transistor TFT1 has its source terminal connected to the adjacent data line DL and its gate terminal connected to the $(i-1)^{th}$ gate line GLi−1. The second thin film transistor TFT2 has its gate terminal connected to the $i^{th}$ gate line GLi and its source terminal connected to the drain terminal of the first thin film transistor TFT1. The third thin film transistor TFT3 has its gate terminal connected to the $(i+1)^{th}$ gate line GLi+1 and its source terminal connected to the drain terminal of the second thin film transistor TFT2. The fourth thin film transistor TFT4 has its gate terminal connected to the $(i+2)^{th}$ gate line GLi+2 and its source terminal connected to the drain terminal of the third thin film transistor TFT2. The drain terminal of the fourth thin film transistor TFT4 is connected to the first liquid crystal cell 50. In this way, the first switching part 58 applies the video signal from the data line DL to the first liquid crystal cell 50, when a driving signal (i.e., gate signal) is applied to the $(i-1)^{th}$ gate line GLi−1, the $i^{th}$ gate line GLi, the $(i+1)^{th}$ gate line GLi+1, and the $(i+2)^{th}$ gate line GLi+2.

The second switching part 60 driving the second liquid crystal cell 52 located in the $i^{th}$ horizontal line includes a fifth thin film transistor TFT5 to a seventh thin film transistor TFT7. The fifth thin film transistor TFT5 has its source terminal connected to the adjacent data line DL and its gate terminal connected to the $(i+1)^{th}$ gate line GLi+1. The sixth thin film transistor TFT6 has its gate terminal connected to the $i^{th}$ gate line GLi and its source terminal connected to the drain terminal of the fifth thin film transistor TFT5. The seventh thin film transistor TFT7 has its gate terminal connected to the $(i-1)^{th}$ gate line GLi−1 and its source terminal connected to the drain terminal of the sixth thin film transistor TFT6. And, the drain terminal of the seventh thin film transistor TFT7 is connected to the second liquid crystal cell 52. In this way, the second switching part 60 applies the video signal from the data line DL to the second liquid crystal cell 52 when a driving signal (i.e., gate signal) is applied to the $(i-1)^{th}$ gate line GLi−1, the $i^{th}$ gate line GLi, and the $(i+1)^{th}$ gate line GLi+1.

The third switching part 62 driving the third liquid crystal cell 54 located in the $i^{th}$ horizontal line includes an eighth thin film transistor TFT8 and a ninth thin film transistor TFT9. The eighth thin film transistor TFT8 has its source terminal connected to the adjacent data line DL and its gate terminal connected to the $i^{th}$ gate line GLi. The ninth thin film transistor TFT9 has its gate terminal connected to the $(i-1)^{th}$ gate line GL1−1 and its source terminal connected to the drain terminal of the eighth thin film transistor TFT8. And, the drain terminal of the ninth thin film transistor TFT9 is connected to the third liquid crystal cell 54. In this way, the third switching part 62 applies the video signal from the data line DL to the third liquid crystal cell 54, when a driving signal (i.e., gate signal) is applied to the $(i-1)^{th}$ gate line GLi−1 and the $i^{th}$ gate line GLi.

The fourth switching part 64 driving the fourth liquid crystal cell 56 located in the $i^{th}$ horizontal line includes a tenth thin film transistor TFT10. The tenth thin film transistor TFT10 has its source terminal connected to the adjacent data line DL and its gate terminal connected to the $(i1)^{th}$ gate line GLi−1. And, the drain terminal of the tenth thin film transistor TFT10 is connected to the fourth liquid crystal cell 56. In this way, the fourth switching part 64 applies the video signal from the data line DL to the fourth liquid crystal cell 56, when a driving signal (i.e., gate signal) is applied to the $(i-1)^{th}$ gate line GLi−1.

The data driver 42 converts data R, G, and B supplied from the timing controller (not shown) into video signals as analog signals and applies to the data lines DL1 to DLm/4.

In this way, the data driver 42 sequentially applies four of the video signals to each of the data lines DL for one horizontal period.

Figure 7:
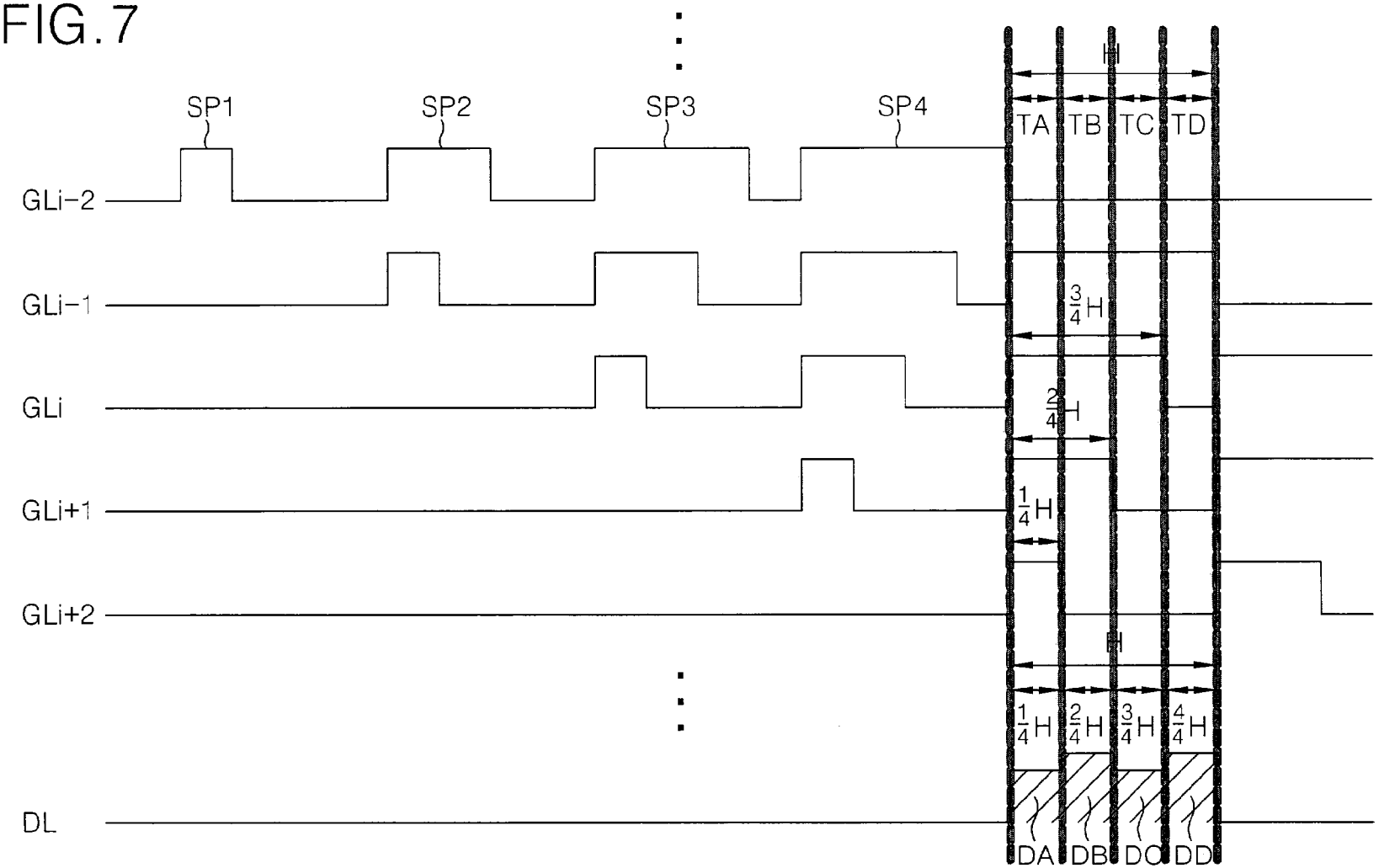
FIG. 7 is a waveform illustrating gate signals applied to the gate lines for driving the liquid crystal cells shown in FIG. 6.

To describe this in detail with reference to FIG. 7, the data driver 42 sequentially applies a first video signal DA, a second video signal DB, a third video signal DC, and a fourth video signal DD to each of the data lines DL for one horizontal period 1H. The first video signal DA is applied to the first liquid crystal cell 50, the second video signal DB is applied to the second liquid crystal cell 52, the third video signal DC is applied to the third liquid crystal cell 54, and the fourth video signal DD is applied to the fourth liquid crystal cell 56.

Herein, the data driver 42 applies each of the video signals DA, DB, DC, and DD for ¼ of a period ¼H, so that the four video signals DA, DB, DC, and DD can be applied for one horizontal period. In other words, the data driver 42 of the present invention applies four video signals to each of the data lines DL for one horizontal period. Accordingly, the data driver 42 of the present invention requires data driver IC's corresponding to only ¼ of the number of data driver IC's of the related art liquid crystal display device shown in FIG. 1, thereby reducing its fabricating cost.

As shown in FIG. 7, the gate driver 44 applies a first gate signal SP1, a second gate signal SP2, a third gate signal SP3, and a fourth gate signal SP4 to each of the gate lines GL1 to GLn in accordance with control signals applied from the timing controller (not shown). Herein, the fourth gate signal SP4 remains at a high state for one horizontal period, the third gate signal SP3 remains at the high state for ¾ of the one horizontal period, the second gate signal SP2 remains at the high state for ⅔ of the one horizontal period, and the first gate signal SP1 remains at the high state for ¼ of the one horizontal period.

On the other hand, the fourth gate signal SP4 is applied to the $(i-1)^{th}$ gate line GLi−1, the third gate signal SP3 is applied to the $i^{th}$ gate line GLi, the second gate signal SP2 is applied to the $(i+1)^{th}$ gate line GLi+1, and the first gate signal SP1 is applied to the $(i+2)^{th}$ gate line GLi+2, at the same time. Accordingly, the fourth gate signal SP4 applied to the $(i-1)^{th}$ gate line GLi−1, the third gate signal SP3 applied to the $i^{th}$ gate line GLi, the second gate signal SP2 applied to the $(i+1)^{th}$ gate line GLi+1, and the first gate signal SP1 applied to the $(i+2)^{th}$ gate line GLi+2 are overlapped during the first period TA.

During a second period TB subsequent to the first period TA, the fourth gate signal SP4 applied to the $(i-1)^{th}$ gate line GLi−1, the third gate signal SP3 applied to the $i^{th}$ gate line GLi, and the second gate signal SP2 applied to the $(i+1)^{th}$ gate line GLi+1 are overlapped. Then, during a third period TC subsequent to the second period TB, the fourth gate signal SP4 applied to the $(i-1)^{th}$ gate line GLi−1, and the third gate signal SP3 applied to the $i^{th}$ gate line GLi are overlapped. And, during a fourth period TD subsequent to the third period TC, the fourth gate signal SP4 is applied to the $(i-1)^{th}$ gate line GLi−1 only.

To describe in detail a process that video signals are applied to the liquid crystal cells 50, 52, 54, and 56 located along with the $i^{th}$ horizontal line, for the first period TA, the fourth to first gate signals SP4 to SP1 are applied to the $(i-1)^{th}$ gate line GLi−1, the $i^{th}$ gate line GLi, the $(i+1)^{th}$ gate line GLi+1, and the $(i+2)^{th}$ gate line GLi+2, respectively. For the first period TA when the fourth to first gate signals SP4, SP3, SP2, and SP1 are simultaneously applied, the first to the fourth thin film transistors TFT1 to TFT4 are turned on. When the first to fourth thin film transistors TFT1 to TFT4 are turned on, the first video signal DA applied to the data line DL is applied to the first liquid crystal cell 50 through the first to fourth thin film transistors TFT1 to TFT4.

For the second period TB, the fourth to second gate signals SP4 to SP2 are applied to the $(i-1)^{th}$ gate line GLi−1, the $i^{th}$ gate line GLi, and the $(i+1)^{th}$ gate line GLi+1, respectively. For the second period TB, the fifth to the seventh thin film transistors TFT5 to TFT7 are turned on, when the fourth to second gate signals SP4, SP3, and SP2 are simultaneously applied. When the fifth to seventh thin film transistors TFT5 to TFT7 are turned on, the second video signal DB applied to the data line DL is applied to the second liquid crystal cell 52 through the fifth to seventh thin film transistors TFT5 to TFT7.

For the third period TC, the fourth to third gate signals SP4 to SP3 are applied to the $(i-1)^{th}$ gate line GLi−1 and the $i^{th}$ gate line GLi, respectively. For the third period TC, the eighth and ninth thin film transistors TFT8 and TFT9 are turned on, when the fourth to third gate signals SP4 and SP3 are applied. When the eighth and ninth thin film transistors TFT8 and TFT9 are turned on, the third video signal DC applied to the data line DL is applied to the third liquid crystal cell 54 through the eighth and ninth thin film transistors TFT8 and TFT9.

For the fourth period TD, the fourth gate signal SP4 is applied to the $(i-1)^{th}$ gate line GLi−1. For the fourth period TD when the fourth gate signal SP4 is applied, the tenth thin film transistor TFT10 is turned on. When the tenth thin film transistor TFT10 is turned on, the fourth video signal DC applied to the data line DL is applied to the fourth liquid crystal cell 56 through the tenth thin film transistor TFT10.

On the other hand, the second liquid crystal cell 52 receives the first video signal DA for the first period TA. However, since the second liquid crystal cell 52 receives the second video signal DB during the second period TB subsequent to the first period TA, a desired video signal DB can be charged to the second liquid cell 52. Further, the third liquid crystal cell 54 receives the first and second video signals DA and DB for the first and second periods TA and TB, respectively. However, the third liquid crystal cell 54 can be charged with the desired video signal because the third video signal DC is applied during the third period TC subsequent to the second period TB. In the same manner, the fourth liquid crystal cell 56 can also be charged with the desired video signal DD.

Figure 8:
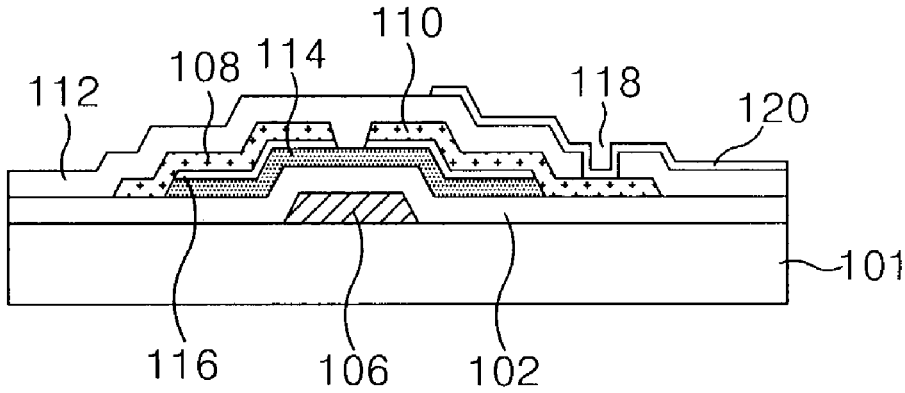
FIG. 8 is a cross-sectional view illustrating the structure of a thin film transistor according to an embodiment of the present invention.

A cross-sectional view of each of thin film transistors TFT in the embodiments of the present invention is illustrated in FIG. 8.

Referring to FIG. 8, the thin film transistor TFT includes a gate electrode 106 formed on a lower substrate 101, a source electrode 108 and a drain electrode 110 formed in layers different from the gate electrode 106. Herein, the drain electrode 110 is formed to make a connection with a pixel electrode 120 through a drain contact hole 118, and the drain electrode 110 is connected to the pixel electrode 120 or the adjacent thin film transistor TFT.

There are an active layer 114 and an ohmic contact layer 116 (collectively called a semiconductor layer) deposited to form a conduction channel between the gate electrode 106, the source electrode 108 and the drain electrode 110. Herein, the active layer 114 is formed between the active layer 114 and the source electrode 108, and the ohmic contact layer 116 is formed between the active layer 114 and the drain electrode 110. The active layer 114 is formed of amorphous silicon that is not doped with impurities, and the ohmic contact layer 116 is formed of amorphous silicon that is doped with impurities of n-type or p-type. These semiconductor layers 114 and 116 apply the voltage supplied to the source electrode 108 to the drain electrode 110 when a voltage is applied to the gate electrode 106. A gate insulating layer 112 is formed between the gate electrode 106 and the semiconductor layers 114 and 116. Further, a protective layer 112 is formed on the source electrode 108 and the drain electrode 110.

The source electrode 108 and the drain electrode 110 of the thin film transistor TFT included in the embodiments of the present invention are formed with a different mask to the semiconductor layers 114 and 116. Accordingly, the source electrode 108 and the drain electrode 110 have a different pattern to the semiconductor layers 114 and 116.

Figure 9:
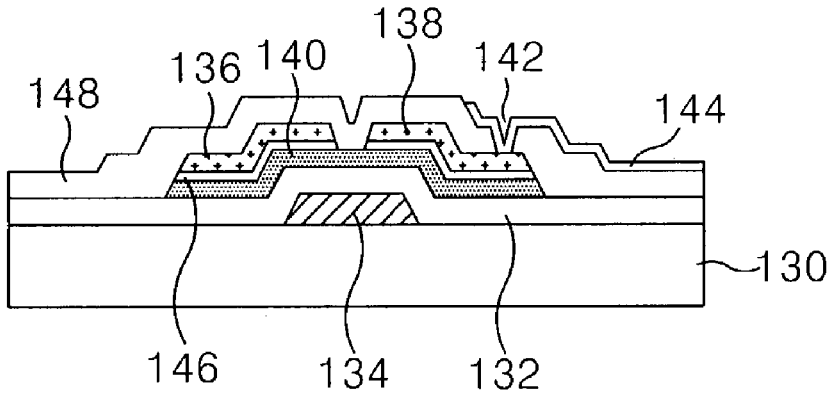
FIG. 9 is a cross-sectional view illustrating the structure of a thin film transistor according to another embodiment of the present invention.

FIG. 9 is a cross-sectional view illustrating a structure of a thin film transistor according to another embodiment of the present invention.

Referring to FIG. 9, a thin film transistor TFT according to another embodiment of the present invention includes a gate electrode 134 formed on a lower substrate 130, a source electrode 136 and a drain electrode 138 formed in layers different from the gate electrode 134. Herein, the drain electrode 138 is formed to make a connection with a pixel electrode 144 through a drain contact hole 142, and the drain electrode 138 is connected to the pixel electrode 144 or the adjacent thin film transistor TFT.

There are an active layer 140 and an ohmic contact layer 146 (collectively called a semiconductor layer) deposited to form a conduction channel between the gate electrode 134, the source electrode 136, and the drain electrode 138. Herein, the active layer 140 is formed between the active layer 140 and the source electrode 136, and the ohmic contact layer 146 is formed between the active layer 140 and the drain electrode 138. The active layer 104 is formed of amorphous silicon that is not doped with impurities, and the ohmic contact layer 146 is formed of amorphous silicon that is doped with impurities of n-type or p-type. When a voltage is applied to the gate electrode, the semiconductor layers 140 and 146 apply the voltage supplied to the source electrode 136 to the drain electrode 138. A gate insulating layer 132 is formed between the gate electrode 134 and the semiconductor layers 140 and 146. Further, a protective layer 148 is formed on the source electrode 136 and the drain electrode 138. The source electrode 136 and the drain electrode 138 of the thin film transistor TFT included in the embodiments of the present invention are formed by using the same mask as the semiconductor layers 140 and 146.

As described above, according to the liquid crystal display device and the driving method thereof in the present invention, one of the data lines is connected to at least three of the liquid crystal cells located along with the $i^{th}$ horizontal line, wherein i is a natural number. Accordingly, since the number of data lines can be reduced and the number of data driver IC's corresponding thereto can also be reduced, its fabricating cost is reduced.

It will be apparent to those skilled in the art that various modifications and variations can be made in the apparatus and method for driving a liquid crystal display device of the present invention without departing from the spirit or scope of the inventions. Thus, it is intended that the present invention covers the modifications and variations of this invention provided they come within the scope of the appended claims and their equivalents.

What is claimed is:

1. A liquid crystal display device, comprising:

a plurality of data lines in a vertical direction;

a plurality of gate lines in a horizontal direction to cross the data lines;

a plurality of liquid crystal cells disposed along each gate line, wherein one of the data lines applies a video signal to at least three liquid crystal cells along a gate line within the plurality of gate lines, and wherein the at least three liquid crystal cells are adjacent to one another and are connected to a shared data line within the plurality of data lines:

a first switching part connected to three gate lines, the shared data line, and a first liquid crystal cell within the at least three liquid crystal cells;

a second switching part connected to two of the three gate lines, the shared data line, and a second liquid crystal cell within the at least three liquid crystal cells; and a third switching part connected to one of the three gate lines, the shared data line, and a third liquid crystal cell within the at least three liquid crystal cells.

2. The liquid crystal display device according to claim 1, wherein the first switching part is connected to an $(i-1)_{th}$ gate line, an $i^{th}$ gate line, and an $(i+1)^{th}$ gate line.

3. The liquid crystal display device according to claim 2, wherein the first switching part applies a video signal to the first liquid crystal cell for a first ⅓ period of one horizontal period.

4. The liquid crystal display device according to claim 1, wherein the second switching part is connected to an $(i-1)^{th}$ gate line and an $i^{th}$ gate line.

5. The liquid crystal display device according to claim 4, wherein the second switching part applies the video signal to the second liquid crystal cell for a second ⅓ period of one horizontal period.

6. The liquid crystal display device according to claim 1, wherein the third switching part is connected to an $(i-1)^{th}$ gate line.

7. The liquid crystal display device according to claim 6, wherein the third switching part applies the video signal to the third liquid crystal cell for a third ⅓ period of one horizontal period.

8. The liquid crystal display device according to claim 1, wherein the first liquid crystal cell, the second liquid crystal cell, and the third liquid crystal cell are arranged to be different from each other in a vertically adjacent position.

9. The liquid crystal display device according to claim 8, wherein the second liquid crystal cell is located above the first liquid crystal cell, and the third liquid crystal cell is located below the second liquid crystal cell in a vertical direction.

10. The liquid crystal display device according to claim 8, wherein the third liquid crystal cell is located above the first liquid crystal cell, and the second liquid crystal cell is located below the first liquid crystal cell in a vertical direction.

11. The liquid crystal display device according to claim 1, wherein each of the first, second, and third liquid crystal cells includes at least one thin film transistor, and each of the thin film transistors includes:

a gate electrode on a substrate;

a gate insulating layer on the gate electrode;

a semiconductor layer on the gate insulating layer;

a source electrode and a drain electrode on the semiconductor layer; and a protective layer on the source electrode and the drain electrode.

12. The liquid crystal display device according to claim 11, wherein the semiconductor layer includes:

an undoped active layer on the gate insulating layer; and a doped ohmic contact layer on the undoped active layer.

13. The liquid crystal display device according to claim 11, wherein the semiconductor layer, the source electrode, and the drain electrode are fonned with a same mask.

14. The liquid crystal display device according to claim 11, wherein the semiconductor layer, the source electrode, and the drain electrode are formed with different masks.

15. The liquid crystal display device according to claim 1, wherein the first, second, third liquid crystal cells, and a fourth liquid crystal cell are arranged adjacent to one another in a horizontal direction.

16. The liquid crystal display device according to claim 15, further comprising:

a first switching part connected to four of the gate lines, including the shared data line, and the first liquid crystal cell;

a second switching part connected to three of the gate lines, including the shared data line, and the second liquid crystal cell;

a third switching part connected to two of the gate lines, including the shared data line, and the third liquid crystal cell; and a fourth switching part connected to the shared data line and the fourth liquid crystal cell.

17. The liquid crystal display device according to claim 16, wherein the first switching part is connected to an $(i-1)^{th}$ gate line, an $i^{th}$ gate line, an $(i+1)^{th}$ gate line, and an $(i+2)^{th}$ gate line.

18. The liquid crystal display device according to claim 17, wherein the first switching part applies the video signal to the first liquid crystal cell for a first ¼ period of one horizontal period.

19. The liquid crystal display device according to claim 16, wherein the second switching part is connected to an $(i-1)^{th}$ gate line, an $i^{th}$ gate line, and an $(i+1)^{th}$ gate line.

20. The liquid crystal display device according to claim 19, wherein the second switching part applies the video signal to the second liquid crystal cell for a second ¼ period of one horizontal period.

21. The liquid crystal display device according to claim 16, wherein the third switching part is connected to an $(i+1)^{th}$ gate line, and an $i^{th}$ gate line.

22. The liquid crystal display device according to claim 21, wherein the third switching part applies the video signal to the third liquid crystal cell for a third ¼ period of one horizontal period.

23. The liquid crystal display device according to claim 16, wherein the fourth switching part is connected to an $(i-1)^{th}$ gate line.

24. The liquid crystal display device according to claim 23, wherein the fourth switching part applies the video signal to the fourth liquid crystal cell for a fourth ¼ period of one horizontal period.

25. The liquid crystal display device according to claim 15, wherein the first, second, third, and fourth liquid crystal cells are arranged to be different from each other in a vertically adjacent position.

26. The liquid crystal display device according to claim 15, wherein each of the first, second, third, and fourth liquid crystal cells includes at least one thin film transistor, and each of the thin film transistors includes:

a gate electrode on a substrate;

a gate insulating layer on the gate electrode;

a semiconductor layer on the gate insulating layer;

a source electrode and a drain electrode on the semiconductor layer; and a protective layer on the source electrode and the drain electrode.

27. The liquid crystal display device according to claim 26, wherein the semiconductor layer includes:

an undoped active layer on the gate insulating layer; and a doped ohmic contact layer on the undoped active layer.

28. The liquid crystal display device according to claim 26, wherein the semiconductor layer, the source electrode, and the drain electrode are formed with the same mask.

29. The liquid crystal display device according to claim 26, wherein the semiconductor layer, the source electrode, and the drain electrode are formed with different masks.

30. A driving apparatus of a liquid crystal display device, comprising:

a plurality of data lines in a vertical direction;

a plurality of gate lines in a horizontal direction to cross the data lines;

a plurality of liquid crystal cells disposed along each gate line;

a data driver that applies a video signal to the data lines;

a gate driver that applies a gate signal to the gate lines;

a first switching part connected to three of the plurality of gate lines, wherein the first switching part applies the video signal supplied to a data line within the plurality of data lines to a first liquid crystal cell within the plurality of liquid crystal cells;

a second switching part connected to two of the plurality of gate lines, wherein the second switching part applies the video signal supplied to the data line to a second liquid crystal cell within the plurality of liquid crystal cells; and a third switching part connected to one of the plurality of gate lines, wherein the third switching part applies the video signal applied to the data line to a third liquid crystal cell within the plurality of liquid crystal cells.

31. The driving apparatus according to claim 30, wherein the data driver sequentially applies three video signals to each data line for one horizontal period.

32. The driving apparatus according to claim 31, wherein the data driver applies a first video signal to the first switching part for a first ⅓ of the horizontal period, applies a second video signal to the second switching part for a second ⅓ of the horizontal period, and applies a third video signal to the third switching part for a third ⅓ of the horizontal period.

33. The driving apparatus according to claim 30, wherein the gate driver applies a first gate signal, a second gate signal, and a third gate signal to each of the gate lines.

34. The driving apparatus according to claim 33, wherein the first gate signal remains at a high state for ⅓ of one horizontal period, the second gate signal remains at the high state for ⅔ of the one horizontal period, and the third gate signal remains at the high state for the one horizontal period.

35. The driving apparatus according to claim 33, wherein the first, second, and third gate signals are applied to three gate lines to turn on the first switching part for the first ⅓ of one horizontal period.

36. The driving apparatus according to claim 33, wherein the second and third gate signals are applied to two gate lines to turn on the second switching part for the second ⅓ of one horizontal period.

37. The driving apparatus according to claim 33, wherein the third gate signal is applied to one gate line to turn on the third switching part for the third ⅓ of one horizontal period.

38. A liquid crystal display device, comprising:

a plurality of data lines in a vertical direction;

a plurality of gate lines in a horizontal direction crossing the data lines;

a plurality of liquid crystal cells disposed along each gate line;

a plurality of switching parts corresponding to the plurality of liquid crystal cells;

a data driver, wherein the data driver applies a video signal to the data lines; and a gate driver, wherein the gate driver applies a gate signal to the gate lines, and wherein the plurality of switching parts includes:

a first switching part connected to four of the plurality of gate lines, wherein the first switching part applies the video signal supplied to a data line within the plurality of data lines to a first liquid crystal cell;

a second switching part connected to three of the plurality of gate lines, wherein the second switching part applies the video signal supplied to the data line within the plurality of data lines to a second liquid crystal cell;

a third switching part connected to two of the plurality of gate lines, wherein the third switching part applies the video signal supplied to the data line within the plurality of data lines to a third liquid crystal cell; and a fourth switching part connected to one of the plurality of gate lines, wherein the fourth switching part applies the video signal supplied to the data line within the plurality of data lines to a fourth liquid crystal cell.

39. The driving apparatus according to claim 38, wherein the data driver sequentially applies four video signals to each data line for a horizontal period.

40. The driving apparatus according to claim 39, wherein the data driver applies a first video signal to the first switching part for a first ¼ of the horizontal period, applies a second video signal to the second switching part for a second ¼ of the horizontal period, applies a third video signal to the third switching part for a third ¼ of the horizontal period, and applies a fourth video signal to the fourth switching part for a fourth ¼ of the horizontal period.

41. The driving apparatus according to claim 38, wherein the gate driver applies a first gate signal, a second gate signal, a third gate signal, and a fourth gate signal to each of the gate lines.

42. The driving apparatus according to claim 41, wherein the first gate signal remains at a high state for ¼ of one horizontal period, the second gate signal remains at the high state for ⅔ of the one horizontal period, the third gate signal remains at the high state for ¾ of the one horizontal period, and the fourth gate signal remains at the high state for the one horizontal period.

43. The driving apparatus according to claim 41, wherein the first, second, third, and fourth gate signals are applied to four gate lines to turn on the first switching part for a first ¼ of one horizontal period.

44. The driving apparatus according to claim 41, wherein the second, third, and fourth gate signals are applied to three gate lines to turn on the second switching part for a second ¼ of one horizontal period.

45. The driving apparatus according to claim 41, wherein the third and fourth gate signals are applied to two gate lines to turn on the third switching part for the third ¼ of one horizontal period.

46. The driving apparatus according to claim 41, wherein the fourth gate signal is applied to one gate line to turn on the fourth switching part for a fourth ¼ of one horizontal period.

47. A method of driving a liquid crystal display device having a plurality of liquid crystal cells, wherein three of the plurality of liquid crystal cells share a data line and are disposed along a single gate line, comprising:

applying three video signals to the data line for one horizontal period;

applying a first gate signal on three gate lines to a first switching part to apply a first of the three video signals to the first liquid crystal cell;

applying a second gate signal on two of the three gate lines to a second switching part to apply a second of the three video signals to the second liquid crystal cell; and applying a third gate signal on one of the three gate lines to a third switching part to apply a third of the three video signals to the third liquid crystal cell.

* * * * *